US012690695B2

(12) United States Patent
Hwa

(10) Patent No.: US 12,690,695 B2
(45) Date of Patent: Jul. 28, 2026

(54) FUNCTIONAL SUPPORTER FOR BABY

(71) Applicant: PROPREBEBE INC., Gunpo-si (KR)

(72) Inventor: Seong Hye Hwa, Gunpo-si (KR)

(73) Assignee: PROPREBEBE INC., Gunpo-si (KR)

( * ) Notice: Subject to any disclaimer, the term of this patent is extended or adjusted under 35 U.S.C. 154(b) by 136 days.

(21) Appl. No.: 18/715,715

(22) PCT Filed: Jul. 21, 2022

(86) PCT No.: PCT/KR2022/010662
§ 371 (c)(1),
(2) Date: Jun. 2, 2024

(87) PCT Pub. No.: WO2023/106540
PCT Pub. Date: Jun. 15, 2023

(65) Prior Publication Data

US 2025/0031868 A1 Jan. 30, 2025

(30) Foreign Application Priority Data

Dec. 6, 2021 (KR) ..... 10-2021-0172749

(51) Int. Cl.
*A47D 5/00* (2006.01)
*A47D 1/00* (2006.01)
(Continued)

(52) U.S. Cl.
CPC ..... *A47D 1/10* (2013.01); *A47D 1/002* (2013.01); *A47D 5/003* (2013.01); *A47D 5/006* (2013.01); *A47K 3/122* (2013.01)

(58) Field of Classification Search
CPC ..... A47D 5/00; A47D 5/006; A47D 5/003; A47D 1/10; A47K 3/122; A47K 3/125;
(Continued)

(56) References Cited

U.S. PATENT DOCUMENTS 2,505,252 A 4/1950 Langley
4,766,620 A 8/1988 Boyhan
(Continued)

FOREIGN PATENT DOCUMENTS

AU 2022403927 A1 6/2024
CN 2421930 Y 3/2001
(Continued)

OTHER PUBLICATIONS

International Search Report of PCT/KR2022/010662 mailed Sep. 21, 2022 from Korean Intellectual Property Office.
(Continued)

*Primary Examiner* — Syed A Islam
(74) *Attorney, Agent, or Firm* — Revolution IP, PLLC

(57) ABSTRACT

A functional supporter includes: a support member having an adhesive tape attached to a bottom surface and a plurality of protruding rails, which extend in one direction while spaced apart from one another at predetermined intervals, protruding upward from an upper surface; a buttocks rest member fixed to the upper surface of the support member and including a first main body portion having the baby's buttocks placed thereon and a first toothed portion protruding downward from the first main body portion and having an outer surface having a toothed shape; and a backrest member including a second main body portion having the baby's back placed thereon and a pair of binding portions protruding from both sides of a lower surface of the second main body portion and extending to be bent inward.

8 Claims, 12 Drawing Sheets

(51) Int. Cl.
*A47D 1/10* (2006.01)
*A47K 3/12* (2006.01)

(58) Field of Classification Search
CPC ..... A47K 3/127; A47K 3/074; A47K 3/024; A47K 3/034; A47K 3/064; A47K 3/164
See application file for complete search history.

(56) References Cited

U.S. PATENT DOCUMENTS

| | | | | |
|---|---|---|---|---|
| 2012/0319436 | A1 | 12/2012 | Kim | |
| 2017/0238766 | A1* | 8/2017 | Harder | B29C 41/38 |
| 2017/0367540 | A1* | 12/2017 | Chang | A47K 3/122 |
| 2021/0031538 | A1 | 2/2021 | Nakagawa et al. | |
| 2025/0031868 | A1 | 1/2025 | Hwa | |

FOREIGN PATENT DOCUMENTS

| | | | |
|---|---|---|---|
| CN | 206880612 | U | 1/2018 |
| CN | 108158458 | A | 6/2018 |
| CN | 208319125 | U | 1/2019 |
| CN | 208463919 | U | 2/2019 |
| CN | 208798937 | U | 4/2019 |
| CN | 213129284 | U | 5/2021 |
| CN | 113273910 | A | 8/2021 |
| DE | 102013109283 | A1 | 3/2015 |
| EP | 4427649 | A1 | 9/2024 |
| JP | 06-029489 | U | 4/1994 |
| JP | 3210128 | U | 4/2017 |
| JP | 6165539 | B2 | 7/2017 |
| KR | 20-1994-0000331 | Y1 | 1/1994 |
| KR | 10-1098725 | B1 | 12/2011 |
| KR | 10-2015-0054407 | A | 5/2015 |
| KR | 10-1817896 | B1 | 1/2018 |
| KR | 10-1978863 | B1 | 5/2019 |
| KR | 10-2026162 | B1 | 9/2019 |
| WO | 2023-106540 | A1 | 6/2023 |

OTHER PUBLICATIONS

Office Action of Japanese Patent Application No. 2024-533815 mailed Apr. 15, 2025.
Office Action of Australia Patent Application No. 2022403927 issued on Jun. 26, 2025.
Office Action of Canada Patent Application No. 3,240,047 issued on Dec. 1, 2025.
Extended European search report of European Patent Application No. 22904377.3 issued on Nov. 21, 2025.
Office Action of Chinese Patent Application No. 202280080619.0. dated Apr. 15, 2026.

* cited by examiner

FUNCTIONAL SUPPORTER FOR BABY

TECHNICAL FIELD

The present invention relates to a functional supporter for a baby, and more particularly, to a functional supporter for a baby that is installed at a side portion of a sink or a washbasin to support a baby's body and allow the baby's body to be washed efficiently.

BACKGROUND ART

Babies are not toilet trained and have delicate skin and thus require frequent bathing to wash off their feces and sweat. However, since babies are unable to keep their balance, and newborns weigh about 3 kg on average while one-year-olds weigh 10 kg or more, it may be very difficult for a caregiver to bathe a baby alone.

In consideration of such aspects, the present specification discloses a functional supporter for a baby that is installed at a side portion of a sink or a washbasin to allow a caregiver to wash a baby's body efficiently and conveniently.

DISCLOSURE

Technical Problem

The present invention relates to a functional supporter for a baby, and more particularly, to a functional supporter for a baby that is installed at a side portion of a sink or a washbasin to support a baby's body and allow the baby's body to be washed efficiently.

Technical Solution

One embodiment of the present invention provides a functional supporter for a baby that is installed at one side portion of a sink or a washbasin and used in placing and washing a baby, the functional supporter including: a support member having an adhesive tape attached to a bottom surface and a plurality of protruding rails, which extend in one direction while spaced apart from one another at predetermined intervals, protruding upward from an upper surface; a buttocks rest member fixed to the upper surface of the support member and including a first main body portion having the baby's buttocks placed thereon and a first toothed portion protruding downward from the first main body portion and having an outer surface having a toothed shape; and a backrest member including a second main body portion having the baby's back placed thereon and a pair of binding portions protruding from both sides of a lower surface of the second main body portion and extending to be bent inward, wherein, as the first main body portion is placed in a space formed by the second main body portion and the pair of binding portions, the first main body portion is disposed under the second main body portion and bound to the second main body portion while fixed to the upper surface of the support member.

A second toothed portion having a toothed shape may be provided at a side surface of an edge of each of the pair of binding portions, the second toothed portion may be connected to a pulling portion installed at the lower surface of the second main body portion and protrude outward or retract inward from the side surface of the edge of each of the pair of binding portions due to an operation of the pulling portion, binding between the first main body portion and the second main body portion may be strengthened by the first toothed portion and the second toothed portion being engaged with and bound to each other, and a cross-sectional area of the second main body portion may be greater than a cross-sectional area of the first main body portion in a plan view.

The functional supporter according to one embodiment of the present invention may further include a cover member having a plate shape in a plan view and a through-hole formed at one side, the support member may have a protruding portion formed to protrude upward from one side of the upper surface, and the cover member may be coupled to the support member by the protruding portion of the support member being inserted into the through-hole.

The first toothed portion may have a round shape, an outer surface of the corresponding round shape may have a toothed shape, an anti-slip plate made of a silicone material may be attached to upper surfaces of the first main body portion and the second main body portion, and an anti-falling step configured to prevent the baby seated on the backrest member from falling may protrude from both side portions of the second main body portion.

In a state in which the first main body portion and the second main body portion are bound to each other, when the pulling portion of the second main body portion is pulled, the second toothed portion may retract inward from the side surface of the edge of each of the pair of binding portions, and the second main body portion may become rotatable and movable back and forth, and when the pulling portion of the second main body portion is not pulled, the second toothed portion may be engaged with the first toothed portion in a state in which rotation of the second main body portion is complete, and the second main body portion may be bound to the first main body portion.

The functional supporter according to one embodiment of the present invention may further include an anti-falling member having a C-shape and connected to both side surfaces of the second main body portion to prevent the baby seated on the backrest member from falling, both side portions of the anti-falling member may each have a length adjustment module configured to adjust a length of the corresponding portion, and a tube configured to inject air may be mounted on an upper end of the anti-falling member.

Another embodiment of the present invention provides a functional supporter for a baby that is installed at one side portion of a sink or a washbasin and used in placing and washing a baby, the functional supporter including: a support member having an adhesive tape attached to a bottom surface and a pair of protruding rails, which extend in one direction while spaced apart from each other at a predetermined interval, protruding upward from an upper surface; a height adjustment member disposed between the pair of protruding rails and fixed to the upper surface of the support member; a pair of angle adjustment members each fixed to one of both side surfaces of the height adjustment member and having a cross-sectional shape in which a first portion having a rectangular cross-section and a second portion extending upward from the corresponding first portion and having a semicircular cross-section are coupled; a buttocks rest member including a fastening portion angle-adjustably fastened to the pair of angle adjustment members, a first main body portion having the baby's buttocks placed thereon, and a first toothed portion interposed between the first main body portion and a binding portion and having an outer surface having a toothed shape; and a backrest member including a second main body portion having the baby's back placed thereon and a pair of binding portions protruding from both sides of a lower surface of the second main body portion and extending to be bent inward, wherein, as the first main body portion is placed in a space formed by the second main body portion and the pair of binding portions, the first main body portion is disposed under the second main body portion and bound to the second main body portion while fixed to the upper surface of the support member, a plurality of holes are formed around a curved circumference of the second portion of the angle adjustment member, in a state in which any one of the holes formed in the angle adjustment member overlaps any one of holes formed in the fastening portion, the buttocks rest member is fastened to the angle adjustment member through a penetrating member configured to simultaneously pass through the corresponding holes, and an angle between the buttocks rest member and the angle adjustment member is adjusted as the holes through which the penetrating member passes are changed.

Both side surfaces of the height adjustment member may each include a recessed rail extending upward and recessed inward, and both side corners of the first portion of the angle adjustment member may each be coupled to one of the recessed rails and coupled to be vertically slidable.

Advantageous Effects

A functional supporter for a baby according to the present invention is installed at one side of a sink or a washbasin by a user and allows the user to wash and bathe a baby conveniently and efficiently using water from a faucet installed at the sink or the washbasin after seating the baby on a buttocks rest member or laying the baby on a backrest member. Further, since the backrest member is designed to be rotatable, the user can perform washing and bathing of the baby in a more comfortable posture, and since a cover member blocks direct contact between the baby's skin and harmful substances present in the sink or the washbasin, the user can wash and bathe the baby in a more sanitary manner.

BEST MODE OF THE INVENTION

Figure 1:
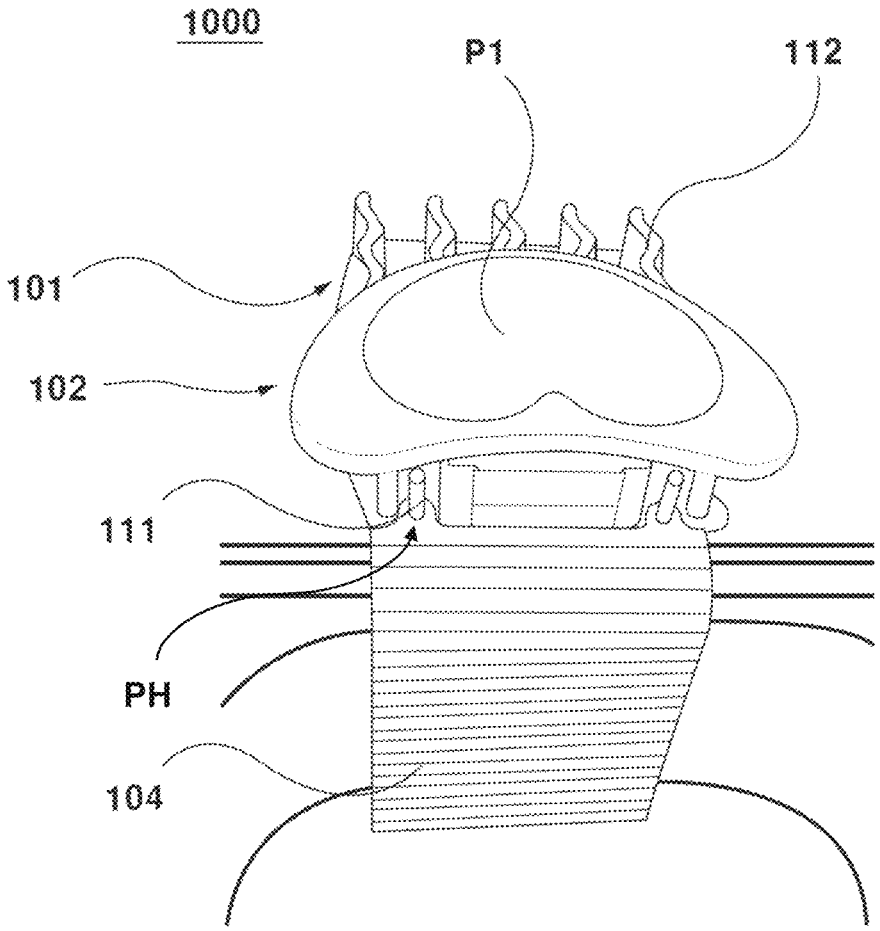
FIG. 1 is a perspective view illustrating a state in which a buttocks rest member and a cover member are installed according to one embodiment of the present invention.

One embodiment of the present invention provides a functional supporter for a baby that is installed at one side portion of a sink or a washbasin and used in placing and washing a baby, the functional supporter including: a support member having an adhesive tape attached to a bottom surface and a plurality of protruding rails, which extend in one direction while spaced apart from one another at predetermined intervals, protruding upward from an upper surface; a buttocks rest member fixed to the upper surface of the support member and including a first main body portion having the baby's buttocks placed thereon and a first toothed portion protruding downward from the first main body portion and having an outer surface having a toothed shape; and a backrest member including a second main body portion having the baby's back placed thereon and a pair of binding portions protruding from both sides of a lower surface of the second main body portion and extending to be bent inward, wherein, as the first main body portion is placed in a space formed by the second main body portion and the pair of binding portions, the first main body portion is disposed under the second main body portion and bound to the second main body portion while fixed to the upper surface of the support member.

Modes of the Invention

Hereinafter, embodiments of the present invention will be described in detail with reference to the accompanying drawings so that those of ordinary skill in the art to which the present invention pertains can easily carry out the present invention. However, the present invention may be implemented in various different forms and is not limited to the embodiments described herein. Also, in the drawings, in order to clearly describe the present invention, parts irrelevant to the description are omitted, and like parts are denoted by like reference numerals throughout the specification.

Throughout the specification, when a certain part is described as being "connected" to another part, this not only includes a case in which the part is "directly connected" to the other part, but also includes a case in which the part is "electrically connected" to the other part with another element disposed therebetween. Also, when a certain part is described as "including" a certain component, unless particularly described otherwise, this means that the part may further include other components instead of excluding other components. Hereinafter, the present invention will be described in detail with reference to the accompanying drawings.

Figure 2:
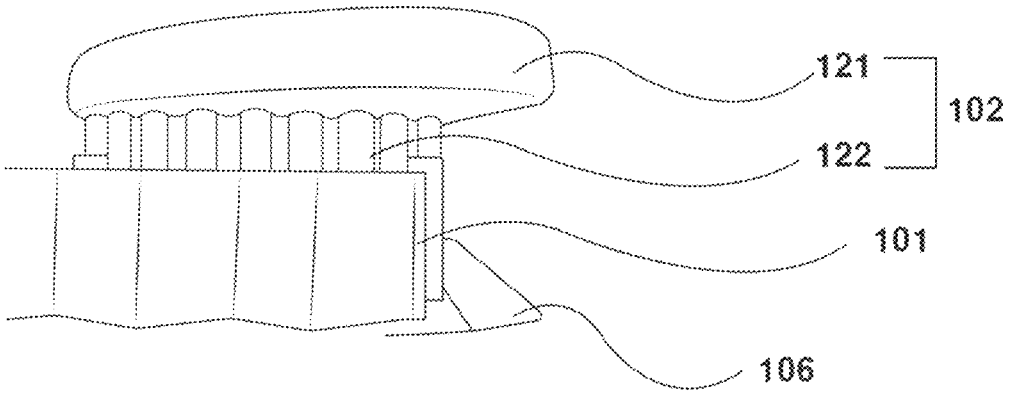
FIG. 2 is a side view illustrating a state in which the buttocks rest member is installed according to one embodiment of the present invention.
Figure 3:
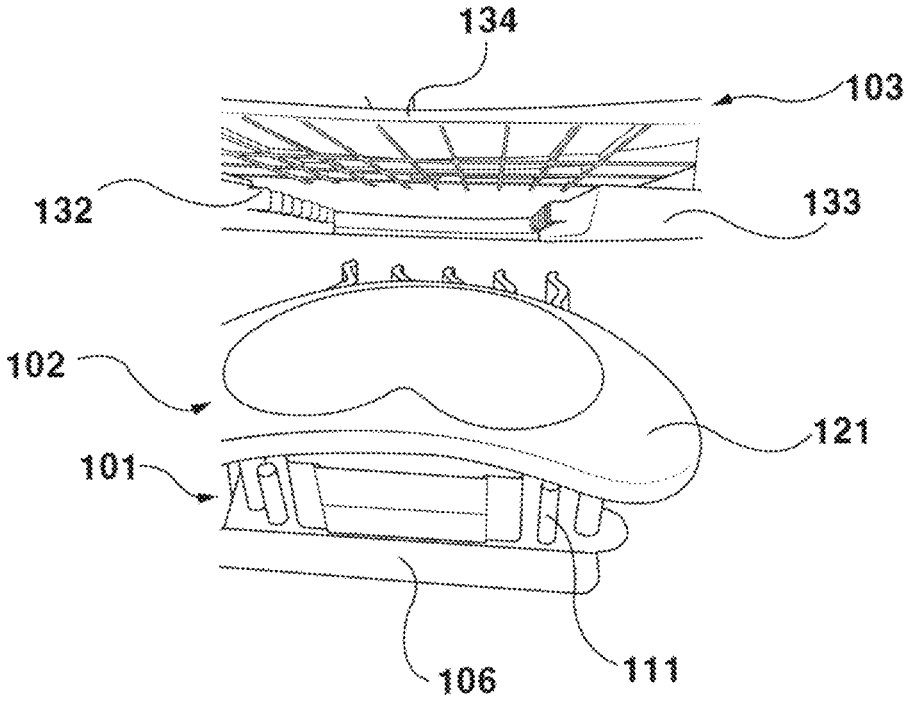
FIG. 3 is a view for describing coupling between a first main body portion and a second main body portion according to one embodiment of the present invention.
Figure 4A:
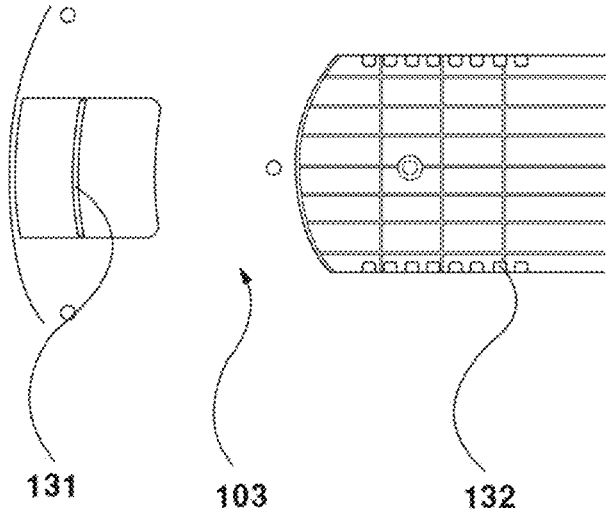
FIGS. 4A and 4B are views for describing an operation of a second toothed portion according to one embodiment of the present invention.
Figure 4B:
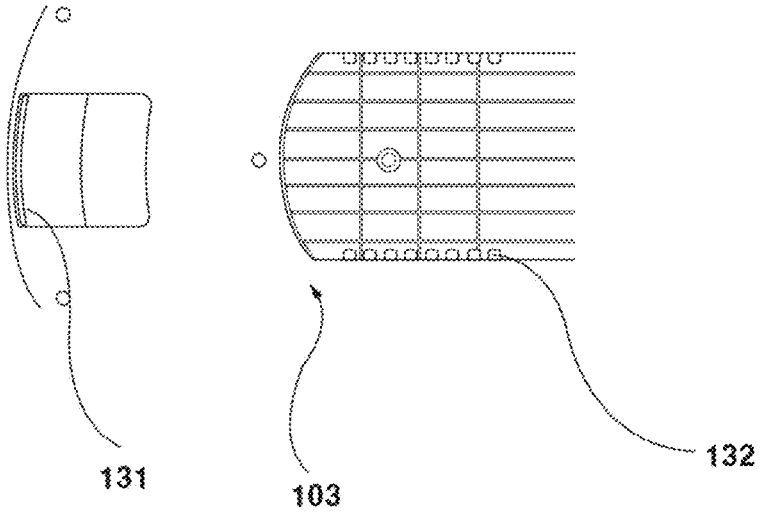

FIG. 1 is a perspective view illustrating a state in which a buttocks rest member 102 and a cover member 104 are installed according to one embodiment of the present invention, FIG. 2 is a side view illustrating a state in which the buttocks rest member 102 is installed according to one embodiment of the present invention, FIG. 3 is a view for describing coupling between a first main body portion 121 and a second main body portion 134 according to one embodiment of the present invention, and FIGS. 4A and 4B are views for describing an operation of a second toothed portion 132 according to one embodiment of the present invention.

Referring to FIGS. 1 to 3, a functional supporter 1000 for a baby according to one embodiment of the present invention may include a support member 101, the buttocks rest member 102, a backrest member 103, and the cover member 104.

The support member 101 may have a thin plate shape and may be made of a plastic material. However, the present invention is not limited thereto, and the support member 101 may be made of a metal material such as aluminum. An adhesive tape may be attached to a bottom surface of the support member 101. Through the corresponding adhesive tape, the support member 101 may be attached to a portion adjacent to a side surface of a sink or a washbasin. A foldable fixing member 106 may be provided at one side end of the support member 101, and as the corresponding fixing member 106 is folded and bound to a bent portion of an upper plate of the sink, the support member 101 may be firmly fixed to the portion adjacent to the side surface of the sink or the washbasin. Further, the fixing member 106 may block water from the sink from entering the functional supporter 1000 for a baby. A plurality of protruding rails 112 protruding upward and extending in one direction may be provided on an upper surface of the support member 101. The plurality of protruding rails 112 may be spaced apart from one another at predetermined intervals. A baby spoon, a pacifier, a liquid medicine container, and the like may be placed between the plurality of protruding rails 112, and the protruding rails 112 may have a zigzag shape as illustrated in FIG. 1 to prevent items placed therebetween from falling. However, the shape of the protruding rails 112 is not limited thereto, and the protruding rails 112 may have various other shapes.

The buttocks rest member 102 may be fixed to the upper surface of the support member 101. The buttocks rest member 102 may be fixed to the upper surface of the support member 101 and may include the first main body portion 121 having the baby's buttocks placed thereon and a first toothed portion 122 protruding downward from the first main body portion 121 and having an outer surface having a toothed shape.

As illustrated in FIG. 2, the first toothed portion 122 may have a round main body, and an outer surface of the round main body may have a toothed shape.

The buttocks of a baby to be bathed may be seated on the buttocks rest member 102, and an anti-slip plate P1 made of a silicone material may be attached to an upper surface of the first main body portion 121 to prevent the baby from sliding.

The backrest member 103 may include the second main body portion 134 and a pair of binding portions 133. The second main body portion 134 may be used for the purpose of placing the baby's back. An anti-falling step 135 configured to prevent the baby seated on the backrest member 103 from falling may be formed to protrude from both side portions of the second main body portion 134. Like the first main body portion 121, an anti-slip plate P2 (see FIG. 5A) made of a silicone material may be attached to an upper surface of the second main body portion 134 to prevent the baby from sliding.

As illustrated in FIG. 3, the pair of binding portions 133 may protrude from both sides of a lower surface of the second main body portion 134 and extend to be bent inward. A second toothed portion 132 having a toothed shape may be provided at a side surface of an edge of each of the pair of binding portions 133.

As the first main body portion 121 is placed in a space formed by the second main body portion 134 and the pair of binding portions 133, the first main body portion 121 may be disposed under the second main body portion 134 and bound to the second main body portion 134 while fixed to the upper surface of the support member 101. A cross-sectional area of the second main body portion 134 is greater than a cross-sectional area of the first main body portion 121 in a plan view, and accordingly, when the first main body portion 121 is bound to the second main body portion 134, the first main body portion 121 may not be visible in a plan view. When seating a baby on the buttocks rest member 102 to wash the baby, the user may detach the backrest member 103 and use only the buttocks rest member 102, and when laying a baby on the backrest member 103 to wash the baby, the user may use the backrest member 103 by coupling the backrest member 103 to the buttocks rest member 102. Hereinafter, coupling between the first main body portion 121 of the buttocks rest member 102 and the second main body portion 134 of the backrest member 103 will be described in more detail.

Referring to FIGS. 4A and 4B, the pair of binding portions 133 may be controlled by a pulling portion 131 installed at the lower surface of the second main body portion 134. The second toothed portion 132 may be connected to the pulling portion 131 installed at the lower surface of the second main body portion 134, and the second toothed portion 132 may protrude outward or retract inward from the side surface of the edge of each of the pair of binding portions 133 due to an operation of the pulling portion 131. Specifically, when the pulling portion 131 is pulled, the second toothed portion 132 may retract inward from the side surface of the edge of each of the pair of binding portions 133, and when the pulling portion 131 is not pulled, the second toothed portion 132 may protrude outward from the side surface of the edge of each of the pair of binding portions 133.

The user may couple the first main body portion 121 and the second main body portion 134 by pulling the pulling portion 131 so that the second toothed portion 132 retracts inward from the side surface of the edge of each of the binding portions 133, placing the first main body portion 121 in the space formed by the second main body portion 134 and the pair of binding portions 133, and releasing the pulled pulling portion 131 so that the second toothed portion 132 protrudes outward from the side surface of the edge of each of the pair of binding portions 133 and is engaged with and coupled to the first toothed portion 122. That is, the user may engage and bind the first toothed portion 122 and the second toothed portion 132 by controlling the pulling portion 131, and accordingly, binding between the first main body portion 121 and the second main body portion 134 may be strengthened.

The cover member 104 may be made of a silicone material, may have a thin plate shape in a plan view, and may have a through-hole PH formed at one side. Referring to FIG. 1, the cover member 104 may be connected to the support member 101. The support member 101 may have a protruding portion 111 formed to protrude upward from one side of the upper surface, and the support member 101 may be coupled to the cover member 104 by the protruding portion 111 of the support member 101 being inserted into the through-hole PH. Since the support member 101 is installed at the portion adjacent to one side of the sink as described above, and the cover member 104 is connected to the one side of the upper surface of the support member 101, the cover member 104 may be unfolded toward the inside of the sink and cover one side surface of the inside of the sink as illustrated in FIG. 1. Since the cover member 104 is provided in this way, when the baby is washed while seated on the buttocks rest member 102, the baby's legs and feet may come in contact with the cover member 104 and may be prevented from coming in direct contact with an inner side surface of the sink that may be stained with harmful substances such as foreign matter.

Figure 5A:
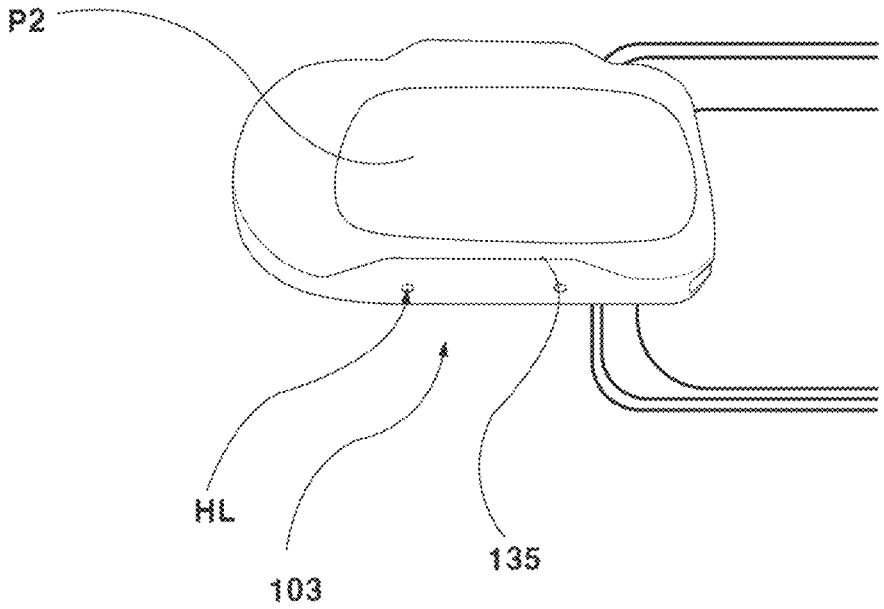
FIGS. 5A to 5C are views for describing an operation of a backrest member according to one embodiment of the present invention.
Figure 5B:
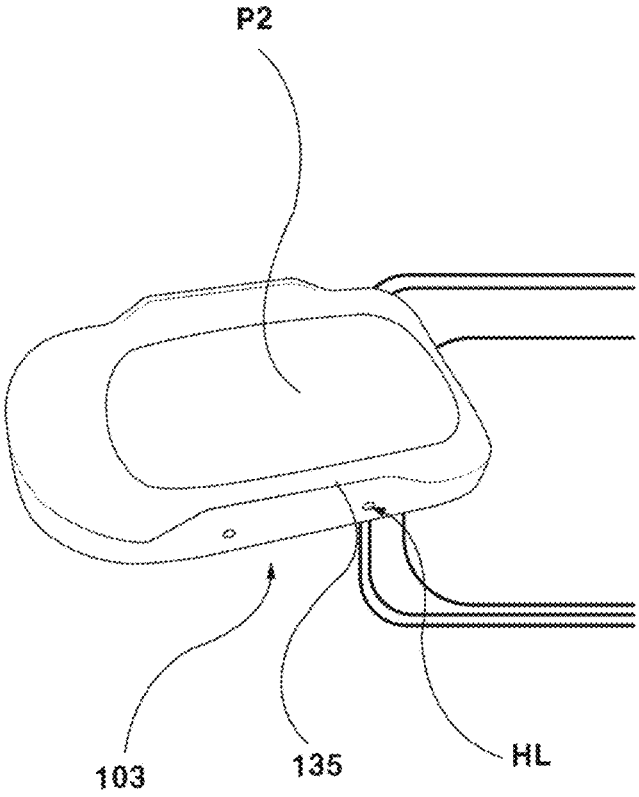
Figure 5C:
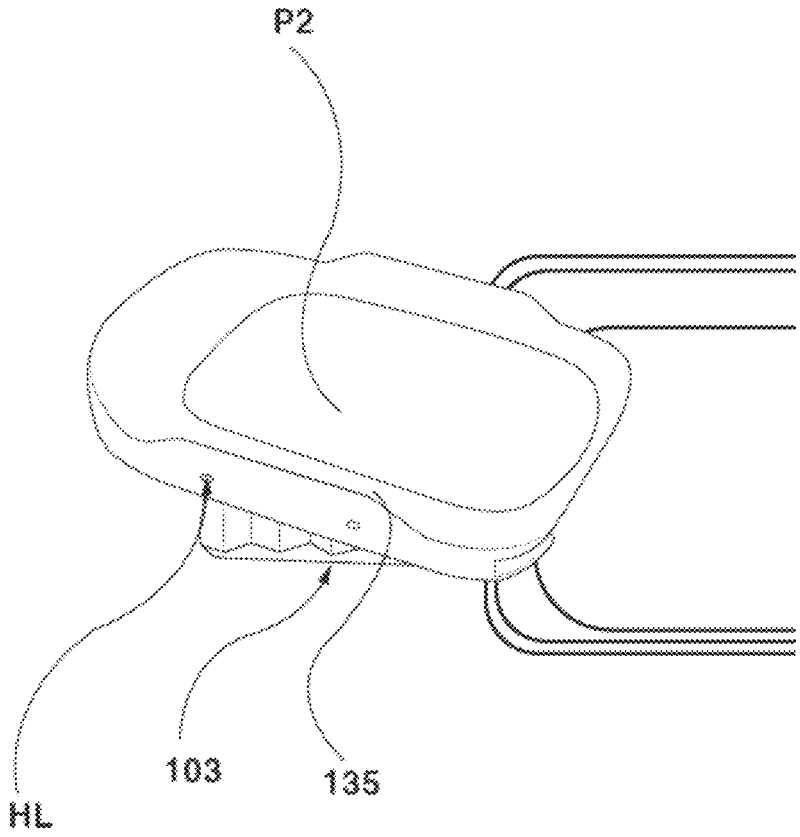
Figure 6:
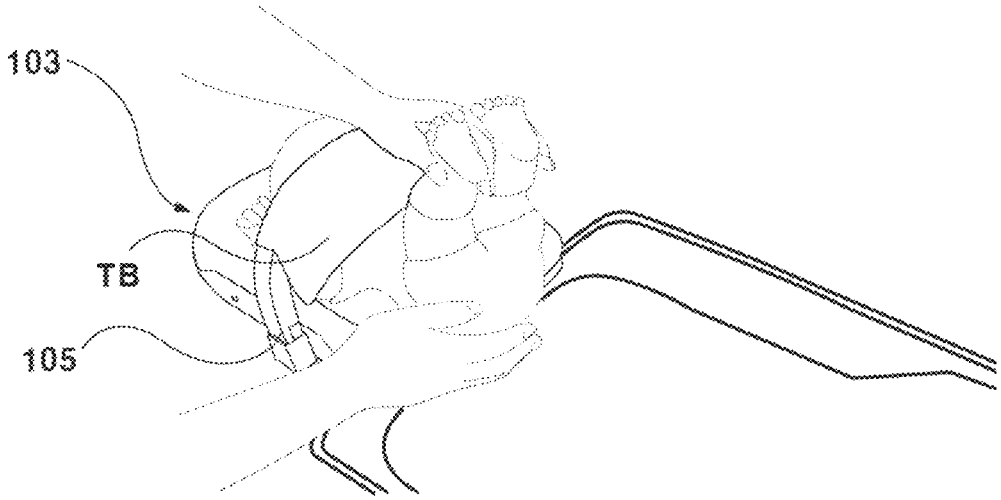
FIG. 6 is a view for describing an anti-falling member according to one embodiment of the present invention.

FIGS. 5A to 5C are views for describing an operation of the backrest member 103 according to one embodiment of the present invention, and FIG. 6 is a view for describing an anti-falling member 105 according to one embodiment of the present invention.

Referring to FIGS. 5A to 5C, the backrest member 103 may rotate while coupled to the buttocks rest member 102. Specifically, when the user pulls the pulling portion 131 of the second main body portion 134 while the first main body portion 121 and the second main body portion 134 are bound to each other, the second toothed portion 132 retracts inward from the side surface of the edge of each of the pair of binding portions 133, and the second main body portion 134 becomes rotatable and movable back and forth (leftward and rightward), and when the user releases the pulled pulling portion after rotating the second main body portion 134 at a desired angle or moving the second main body portion 134 back and forth, the second toothed portion 132 is engaged with the first toothed portion 122, and the second main body portion 134 and the first main body portion 121 may be bound to each other again. The first toothed portion 122 bound to the second toothed portion 132 has a round shape as described above, which allows the backrest member 103 to rotate and move back and forth.

Referring to FIG. 6, the anti-falling member 105 may have a C-shape and may be connected to both side surfaces of the second main body portion 134. Holes to which the anti-falling member 105 may be coupled may be formed in both side surfaces of the second main body portion 134, and both side portions of the anti-falling member 105 may be coupled to the corresponding holes. Both side surfaces of the second main body portion 134 may each have a plurality of holes formed therein, and the user may select holes to be connected to the anti-falling member 105 and connect the anti-falling member 105 to the second main body portion 134.

Also, both side portions of the anti-falling member 105 may each have a length adjustment module configured to adjust a length of the corresponding side portion.

In order to prevent the baby laying on the backrest member 103 from falling from the backrest member 103, the user may couple the anti-falling member 105 to the backrest member 103 and adjust the height of the anti-falling member 105 according to the height of the baby by using the length adjustment module.

Also, a tube TB may be mounted on an upper end of the anti-falling member 105. While using the functional supporter 1000 for a baby, the user may inject a suitable amount of air into the tube TB according to the baby's growth for the tube TB to press the baby with a suitable pressure and stably hold the baby.

In this way, the functional supporter 1000 for a baby according to the present invention is installed at one side of a sink or a washbasin by a user and allows the user to wash and bathe a baby conveniently and efficiently using water from a faucet installed at the sink or the washbasin after seating the baby on the buttocks rest member 102 or laying the baby on the backrest member 103. Further, since the backrest member 103 is designed to be rotatable, the user can perform washing and bathing of the baby in a more comfortable posture, and since the cover member 104 blocks direct contact between the baby's skin and harmful substances present in the sink or the washbasin, the user can wash and bathe the baby in a more sanitary manner.

Figure 7:
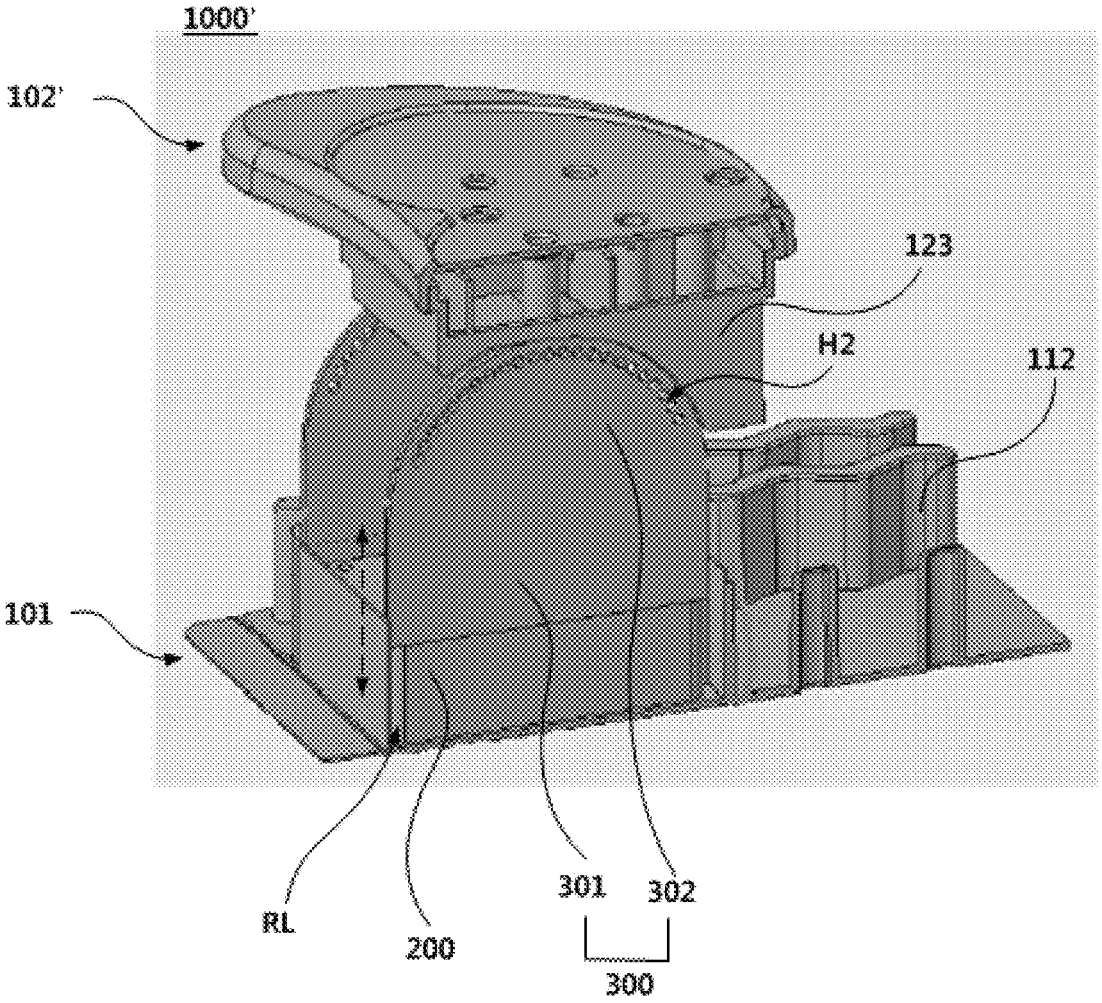
FIG. 7 is a detailed view of a functional supporter for a baby according to another embodiment of the present invention.
Figure 8A:
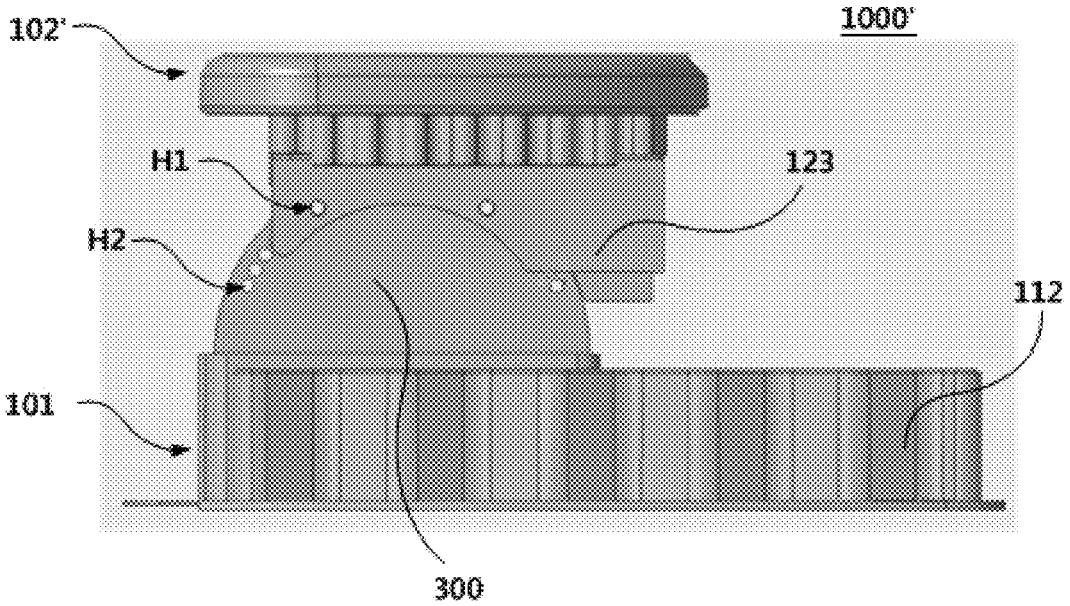
FIGS. 8A to 8C are views for describing angle adjustment of a buttocks rest member according to an angle adjustment member according to another embodiment of the present invention.
Figure 8B:
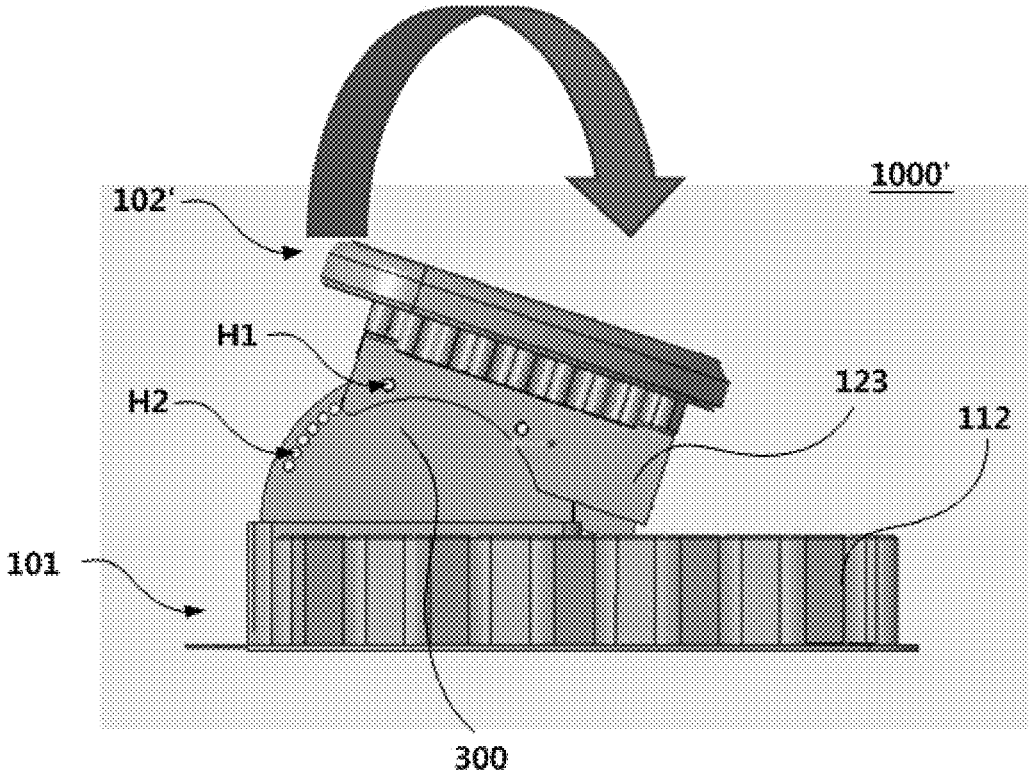
Figure 8C:
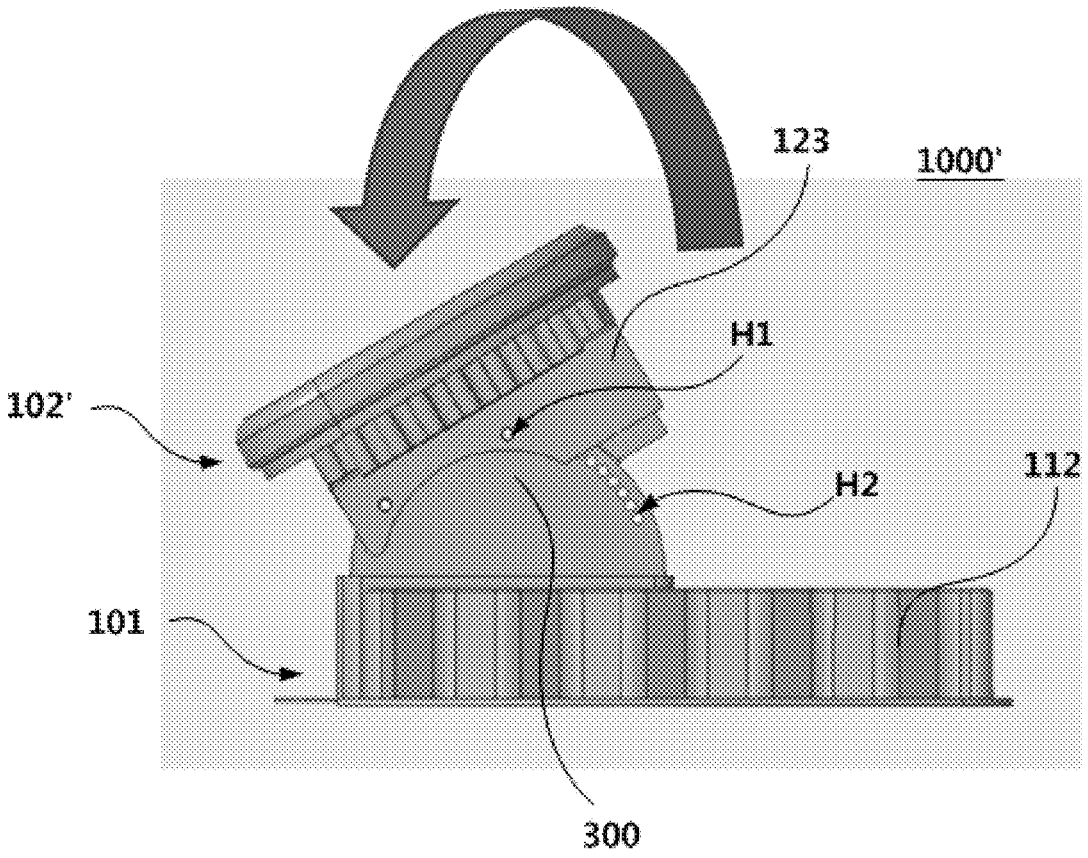

FIG. 7 is a detailed view of a functional supporter 1000' for a baby according to another embodiment of the present invention, and FIGS. 8A to 8C are views for describing angle adjustment of a buttocks rest member 102' according to an angle adjustment member 300 according to another embodiment of the present invention.

Description of components overlapping with those of the above-described functional supporter 1000 for a baby will be omitted, and only additional configurations will be described with reference to FIGS. 7 to 8C.

The functional supporter 1000' for a baby according to another embodiment of the present invention may further include a height adjustment member 200 and a pair of angle adjustment members 300.

The height adjustment member 200 may be disposed between the pair of protruding rails 112 and fixed to the upper surface of the support member 101. The height adjustment member 200 may have a rectangular parallelepiped shape, and both side surfaces of the height adjustment member 200 may each have a recessed rail RL formed therein. More specifically, a recessed rail RL extending upward and recessed inward may be included in both corners of both side surfaces of the height adjustment member 200.

The angle adjustment members 300 may each be fixed to one of both side surfaces of the height adjustment member 200. The angle adjustment member 300 may include a first portion 301 and a second portion 302. The first portion 301 may have a rectangular cross-section, and the second portion 302 may extend upward from the first portion 301 and have a semicircular cross-section. The first portion 301 and the second portion 302 may be integrally coupled.

Unlike in FIG. 1, the buttocks rest member 102' may be fastened and coupled to the angle adjustment members 300. The buttocks rest member 102' may include a fastening portion 123, the first main body portion 121 (see FIG. 2), and the first toothed portion 122 (see FIG. 2). The fastening portion 123 may be angle-adjustably fastened to the pair of angle adjustment members 300. The first main body portion 121 has been described above with reference to FIG. 1, and thus description thereof will be omitted. The first toothed portion 122 may be interposed between the first main body portion 121 and the binding portion 133 in the present embodiment. Other aspects of the first toothed portion 122 are the same as in FIG. 1, and thus description thereof will be omitted.

A plurality of holes H2 may be formed around a curved circumference of the second portion 302 of the angle adjustment member 300.

In a state in which any one of the holes H2 formed in the angle adjustment member 300 overlaps any one of holes H1 formed in the fastening portion 123, the buttocks rest member 102' may be fastened to the angle adjustment member 300 through a penetrating member (not illustrated) configured to simultaneously pass through the corresponding holes H1 and H2. As shown in FIGS. 8A, 8B, and 8C, the angle of the buttocks rest member 102' may be adjusted by the user selecting any one of the holes H1 formed in the fastening portion 123 and any one of the holes H2 formed in the angle adjustment member 300, overlapping the selected holes H1 and H2, and placing the penetrating member to simultaneously pass through the selected holes H1 and H2. In one example of the present invention, the penetrating member may be a bolt. That is, the angle between the buttocks rest member 102' and the angle adjustment member 300 may be adjusted as the holes through which the penetrating member passes are changed.

The first portion 301 of the angle adjustment member 300 may be coupled to the recessed rail RL and slide vertically. Both side corners of the first portion 301 of the angle adjustment member 300 may be coupled to the recessed rail RL and coupled to be vertically slidable. For example, both side corners of the first portion 301 of the angle adjustment member 300 may each be coupled to one of the pair of recessed rails RL by a fastening member (not illustrated) or the like, and the user may weaken a fastening strength of the corresponding fastening member (for example, the fastening member may be a bolt, and the fastening strength may be weakened by loosening the bolt), adjust the height of the angle adjustment member 300, and, after adjusting the height of the angle adjustment member 300 to a desired height, strengthen the fastening strength of the fastening member to fix the angle adjustment member 300 at the corresponding height.

In this way, the functional supporter 1000' for a baby according to another embodiment of the present invention further includes the height adjustment member 200, the angle adjustment members 300, and the fastening portion 123 of the buttocks rest member 102' in addition to the components of the functional supporter 1000 for a baby described above with reference to FIG. 1. Accordingly, the user may perform washing of the baby's buttocks or head at various angles while laying the baby on the backrest member and may easily perform washing of the baby even at a high washbasin by increasing the height of the backrest member using the height adjustment member 200. As a result, convenience of the user may be improved.

The above-described embodiments are only for illustrative purposes, and those of ordinary skill in the art to which the above-described embodiments pertain should understand that the above-described embodiments may be easily modified to other specific forms without changing the technical spirit or essential features of the above-described embodiments. Therefore, the above-described embodiments should be understood as illustrative, instead of limiting, in all aspects. For example, each component described as a single type may be embodied in a distributed manner, and likewise, components described as being distributed may be embodied in a combined form.

The scope of the present specification is shown by the claims below rather than by the detailed description above, and all changes or modifications derived from the meaning and scope of the claims and their equivalent concepts should be construed as falling within the scope of the present specification.

The invention claimed is:

1. A functional supporter for a baby that is installed at one side portion of a sink or a washbasin and used in placing and washing a baby, the functional supporter comprising:

a support member having an adhesive tape attached to a bottom surface and a plurality of protruding rails, which extend in one direction while spaced apart from one another at predetermined intervals, protruding upward from an upper surface;

a buttocks rest member fixed to the upper surface of the support member and including a first main body portion having the baby's buttocks placed thereon and a first toothed portion protruding downward from the first main body portion and having an outer surface having a toothed shape; and a backrest member including a second main body portion having the baby's back placed thereon and a pair of binding portions protruding from both sides of a lower surface of the second main body portion and extending to be bent inward, wherein, as the first main body portion is placed in a space formed by the second main body portion and the pair of binding portions, the first main body portion is disposed under the second main body portion and bound to the second main body portion while fixed to the upper surface of the support member.

2. The functional supporter of claim 1, wherein:

a second toothed portion having a toothed shape is provided at a side surface of an edge of each of the pair of binding portions;

the second toothed portion is connected to a pulling portion installed at the lower surface of the second main body portion and protrudes outward or retracts inward from the side surface of the edge of each of the pair of binding portions due to an operation of the pulling portion;

binding between the first main body portion and the second main body portion is strengthened by the first toothed portion and the second toothed portion being engaged with and bound to each other; and a cross-sectional area of the second main body portion is greater than a cross-sectional area of the first main body portion in a plan view.

3. The functional supporter of claim 2, further comprising a cover member having a plate shape in a plan view and a through-hole formed at one side, wherein the support member has a protruding portion formed to protrude upward from one side of the upper surface, and the cover member is coupled to the support member by the protruding portion of the support member being inserted into the through-hole.

4. The functional supporter of claim 3, wherein:

the first toothed portion has a round shape, and an outer surface of the corresponding round shape has a toothed shape;

an anti-slip plate made of a silicone material is attached to upper surfaces of the first main body portion and the second main body portion; and an anti-falling step configured to prevent the baby seated on the backrest member from falling protrudes from both side portions of the second main body portion.

5. The functional supporter of claim 4, wherein, in a state in which the first main body portion and the second main body portion are bound to each other, when the pulling portion of the second main body portion is pulled, the second toothed portion retracts inward from the side surface of the edge of each of the pair of binding portions, and the second main body portion becomes rotatable and movable back and forth, and when the pulling portion of the second main body portion is not pulled, the second toothed portion is engaged with the first toothed portion in a state in which rotation of the second main body portion is complete, and the second main body portion is bound to the first main body portion.

6. The functional supporter of claim 5, further comprising an anti-falling member having a C-shape and connected to both side surfaces of the second main body portion to prevent the baby seated on the backrest member from falling, wherein a tube configured to inject air is mounted on an upper end of the anti-falling member.

7. A functional supporter for a baby that is installed at one side portion of a sink or a washbasin and used in placing and washing a baby, the functional supporter comprising:

a support member having an adhesive tape attached to a bottom surface and a pair of protruding rails, which extend in one direction while spaced apart from each other at a predetermined interval, protruding upward from an upper surface;

a height adjustment member disposed between the pair of protruding rails and fixed to the upper surface of the support member;

a pair of angle adjustment members each fixed to one of both side surfaces of the height adjustment member and having a cross-sectional shape in which a first portion having a rectangular cross-section and a second portion extending upward from the corresponding first portion and having a semicircular cross-section are coupled;

a buttocks rest member including a fastening portion angle-adjustably fastened to the pair of angle adjustment members, a first main body portion having the baby's buttocks placed thereon, and a first toothed portion interposed between the first main body portion and a binding portion and having an outer surface having a toothed shape; and a backrest member including a second main body portion having the baby's back placed thereon and a pair of binding portions protruding from both sides of a lower surface of the second main body portion and extending to be bent inward, wherein, as the first main body portion is placed in a space formed by the second main body portion and the pair of binding portions, the first main body portion is disposed under the second main body portion and bound to the second main body portion while fixed to the upper surface of the support member, and a plurality of holes are formed around a curved circumference of the second portion of the angle adjustment member, in a state in which any one of the holes formed in the angle adjustment member overlaps any one of holes formed in the fastening portion, the buttocks rest member is fastened to the angle adjustment member through a penetrating member configured to simultaneously pass through the corresponding holes, and an angle between the buttocks rest member and the angle adjustment member is adjusted as the holes through which the penetrating member passes are changed.

8. The functional supporter of claim 7, wherein:

both side surfaces of the height adjustment member each include a recessed rail extending upward and recessed inward; and both side corners of the first portion of the angle adjustment member are each coupled to one of the recessed rails and coupled to be vertically slidable.

* * * * *